US005168821A

United States Patent [19]

Kamiya

[11] Patent Number: 5,168,821

[45] Date of Patent: Dec. 8, 1992

[54] SEWING MACHINE HAVING A THREADING DEVICE

[75] Inventor: Osamu Kamiya, Chiryu, Japan

[73] Assignee: Brother Kogyo Kabushiki Kaisha, Nagoya, Japan

[21] Appl. No.: 793,026

[22] Filed: Nov. 15, 1991

[30] Foreign Application Priority Data

Dec. 7, 1990 [JP] Japan ..... 2-407401

[51] Int. Cl.[5] ..... D05B 57/02

[52] U.S. Cl. ..... 112/199; 112/225

[58] Field of Search ..... 112/197, 199, 224, 225, 112/302, 162, 165

[56] References Cited

U.S. PATENT DOCUMENTS

| | | | |
|---|---|---|---|
| 1,801,166 | 12/1928 | Maier | 112/225 |
| 2,483,595 | 10/1949 | Olson | 112/225 |
| 4,300,463 | 12/1981 | Morimoto | 112/225 |
| 4,461,409 | 7/1984 | Biemans | 112/225 X |
| 4,557,408 | 12/1985 | Biemans | 112/225 X |
| 4,649,843 | 3/1987 | Muroi et al. | 112/225 X |
| 4,977,842 | 12/1990 | Fukao et al. | 112/302 X |
| 5,020,462 | 6/1991 | Sato et al. | 112/302 |
| 5,076,181 | 12/1991 | Wang | 112/302 X |

FOREIGN PATENT DOCUMENTS

| | | | |
|---|---|---|---|
| 59-118191 | 7/1984 | Japan | 112/302 |
| 61-18473 | 5/1986 | Japan . | |

*Primary Examiner*—Werner H. Schroeder
*Assistant Examiner*—Paul C. Lewis
*Attorney, Agent, or Firm*—Oliff & Berridge

[57] ABSTRACT

In threading an eyelet of a looper of a sewing machine, a slide member is displaced until a positioning portion of the slide member comes into contact with the looper. In this contact condition, a thread pushing projection for pushing a looper thread is displaced to penetrate into the eyelet of the looper so that the looper thread pushed by the thread pushing projection passes through the eyelet of the looper. The looper thread having passed through the eyelet is grasped by a grasping portion of the slide member. Thereafter, the thread pushing projection is retracted from the eyelet of the looper, and the slide member is returned to an original position, thus completing the threading operation.

20 Claims, 6 Drawing Sheets

SEWING MACHINE HAVING A THREADING DEVICE

BACKGROUND OF THE INVENTION

1. Field of the Invention

The invention relates to a sewing machine having a threading device for threading an eyelet of a looper, and more particularly to a sewing machine having a threading device designed to effect threading by advancing a thread pusher together with a thread into the eyelet of the looper and then retracting the thread pusher only from the eyelet of the looper.

2. Description of Related Art

In a chain stitch sewing machine, a lower looper is provided so as to be swingable in synchronism with a needle bar. In a conventional chain stitch sewing machine, an operation of threading an eyelet of the lower looper is manually carried out by an operator with use of a pincette.

However, in the conventional chain stitch sewing machine, other parts are arranged around the periphery of the lower looper, so that the threading operation using a pincette is complicated and requires considerable skill. In this circumstance, an operator of little skill is apt to make an error in the threading operation. In particular, since the thread to be inserted through the eyelet of the lower looper is usually a special thread, such as a thick thread or a stretchable thread, the threading operation is difficult for the operator.

As a technique to cope with this problem, there is disclosed a threading device in Japanese Patent Publication No. 61-18473. This threading device includes a complicated link mechanism and it is, therefore, very difficult to install the device in the bed of a sewing machine body. Moreover, manufacturing costs are increased and it is also very difficult to manufacture a sewing machine having such a threading device.

SUMMARY OF THE INVENTION

It is an object of the invention to provide a sewing machine which can thread an eyelet of a looper securely and easily.

It is another object of the present invention to provide a sewing machine which can thread an eyelet of a looper securely while having a simple construction.

According to the invention, there is provided a sewing machine having a threading device, comprising a needle bar adapted to be reciprocated, the needle bar having a needle mounted thereon; a looper adapted to be swung in synchronism with the needle bar, the looper having an eyelet; a supporting member adapted to be displaced relative to the looper, the supporting member having a positioning portion adapted to contact the looper; a thread pushing projection displaceably provided on the supporting member for pushing a thread toward the eyelet of the looper, the thread pushing projection being adapted to penetrate into and retract from the eyelet of the looper under the condition where the positioning portion of the supporting member is in contact with the looper; and a grasping portion provided on the supporting member for grasping the thread pushed so as to be inserted through the eyelet of the looper by the thread pushing projection.

With this structure, in threading the eyelet of the looper, the supporting member is displaced until the positioning portion of the supporting member comes into contact with the looper. In this contact condition, the thread pushing projection for pushing the looper thread is displaced to penetrate into the eyelet of the looper so that the looper thread pushed by the thread pushing projection is allowed to pass through the eyelet of the looper. The looper thread having passed through the eyelet is grasped by the grasping portion of the supporting member. Thereafter, the thread pushing projection is retracted from the eyelet of the looper, and the supporting member is returned to an original position, thus completing the threading operation.

Accordingly, the threading through the eyelet of the looper can be effected by firstly moving the supporting member to contact the same with the looper and then advancing the thread pushing projection into the eyelet of the looper. Thus, the operator can easily carry out the threading operation as compared with that in the prior art sewing machine using a pincette. Further, the sewing machine is simple in construction such that the supporting member is displaceable, and the thread pushing projection and the grasping portion are provided on the supporting member. Accordingly manufacturing costs can be reduced.

As described above, according to the sewing machine of the present invention, the operation of threading the eyelet of the looper can be carried out securely and easily using a simple structure.

BRIEF DESCRIPTION OF THE DRAWINGS

A preferred embodiment of the invention will be described in detail with reference to the following figures wherein.

DETAILED DESCRIPTION OF THE PREFERRED EMBODIMENTS

Figure 1:
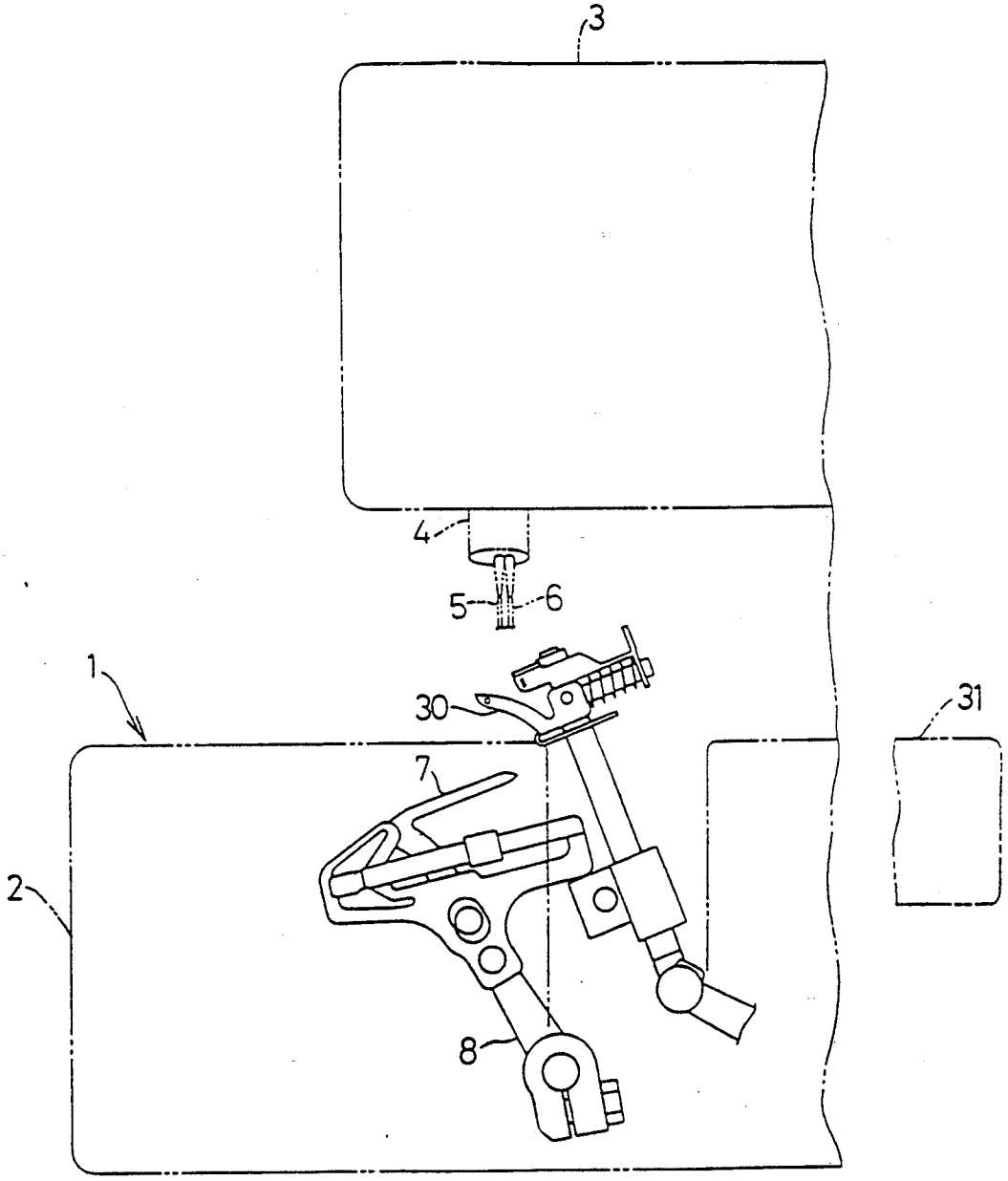
FIG. 1 is a front elevation of a part of a sewing machine according to a preferred embodiment of the invention.
Figure 2:
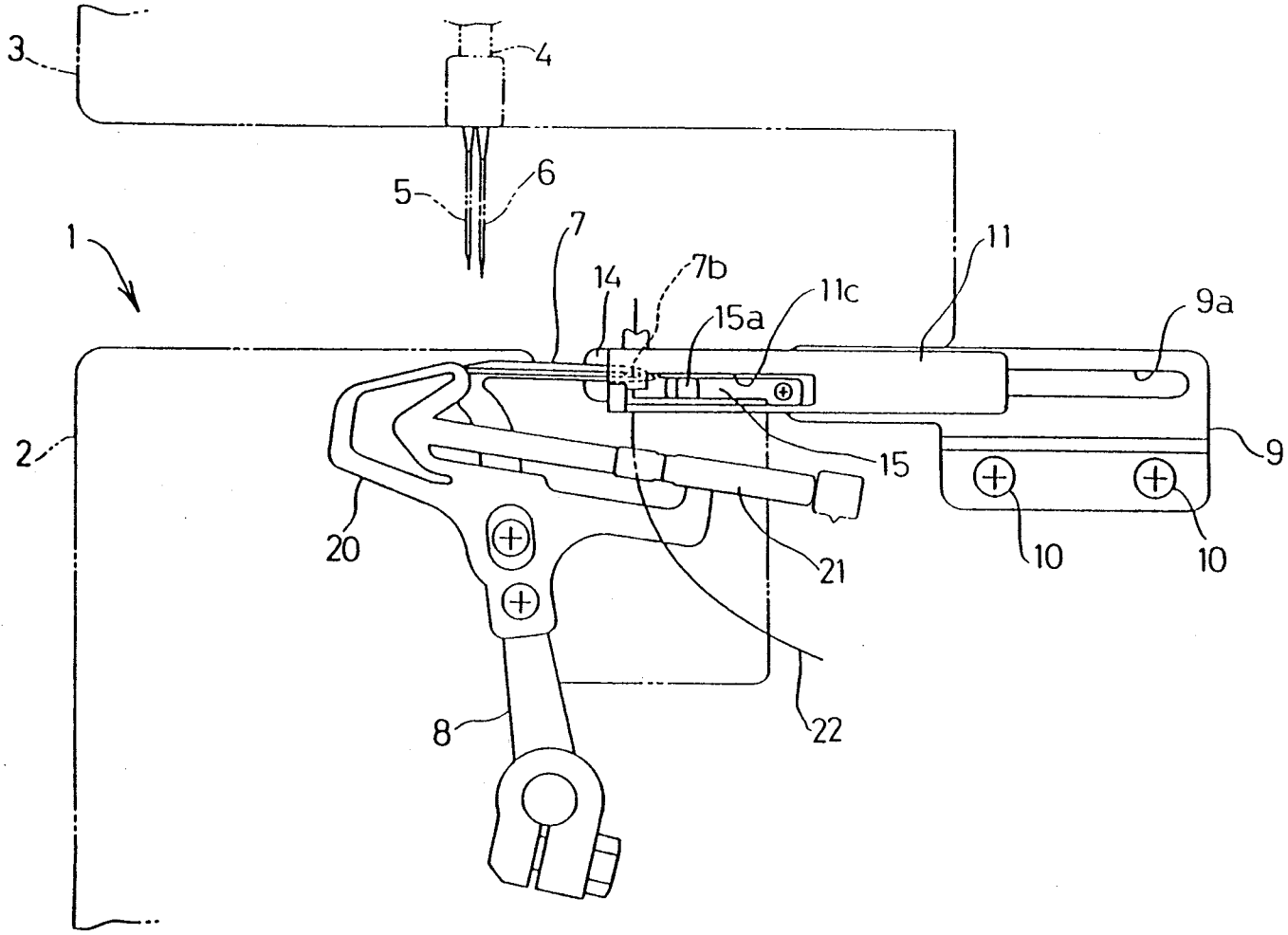
FIG. 2 is a front elevation of a lower looper and a slide member.

Referring to FIGS. 1 and 2, a sewing machine body 1 is constituted of a bed 2 and an arm 3 rising from a right end portion (not shown) of the bed 2 and then extending leftwardly. A needle bar 4 is vertically movably provided in a left end portion of the arm 3. Two needles 5 and 6 are mounted to a lower end portion of the needle bar 4. The needle bar 4 is adapted to be vertically driven by a machine motor (not shown) through an upper shaft, a crank mechanism, etc. (not shown).

A lower looper 7 is provided in the bed 2 so as to be swingable in right and left directions as viewed in FIGS. 1 and 2. The lower looper 7 is adapted to be driven by the machine motor through a driving mechanism 8 in synchronism with the needle bar 4 to carry out a needle thread taking motion. An upper looper 30 is provided so as to be swingable in synchronism with the lower looper 7. The upper looper 30 serves to take a lower looper thread 22.

A mounting plate 9 is fixed by screws 10 to the bed 2 at a position on the right-hand side of the lower looper 7.

As shown in FIG. 2, the mounting plate 9 is formed at its upper portion with an elongated hole 9*a* extending in a horizontal direction as viewed in FIG. 2. A slide member 11, as the supporting member according to the invention, is mounted on the mounting plate 9 so as to be movable in the horizontal direction.

Figure 3:
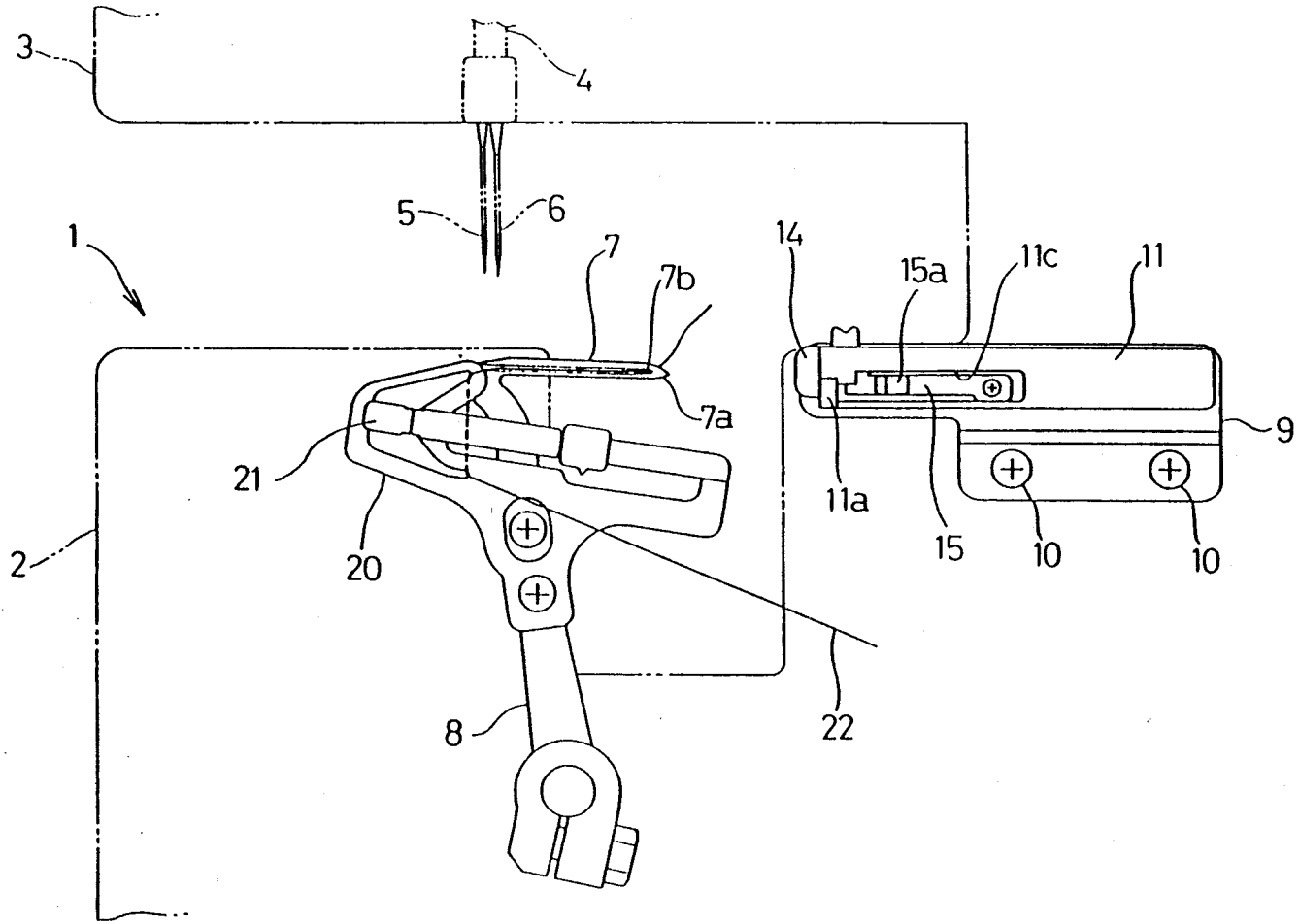
FIG. 3 is a front elevation illustrating the condition that the threading through the lower looper has been completed.
Figure 4:
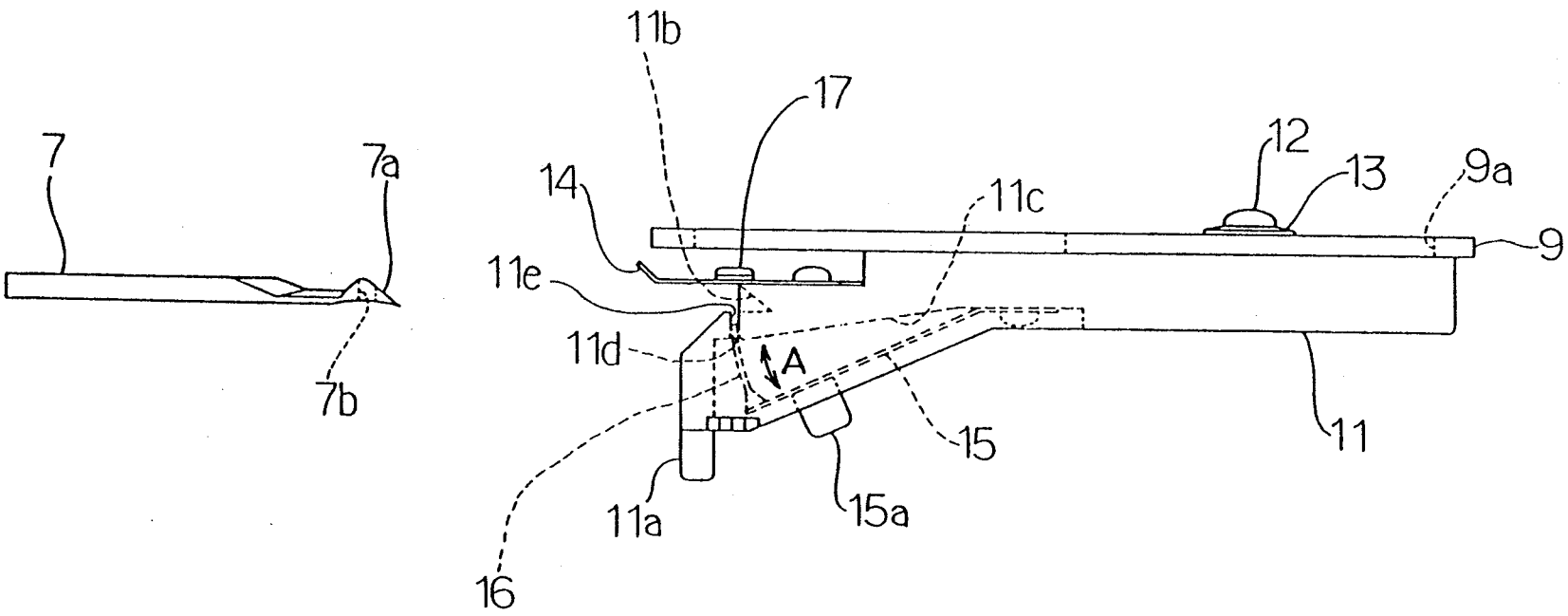
FIG. 4 is a top plan view of the lower looper and the slide member.
Figure 5:
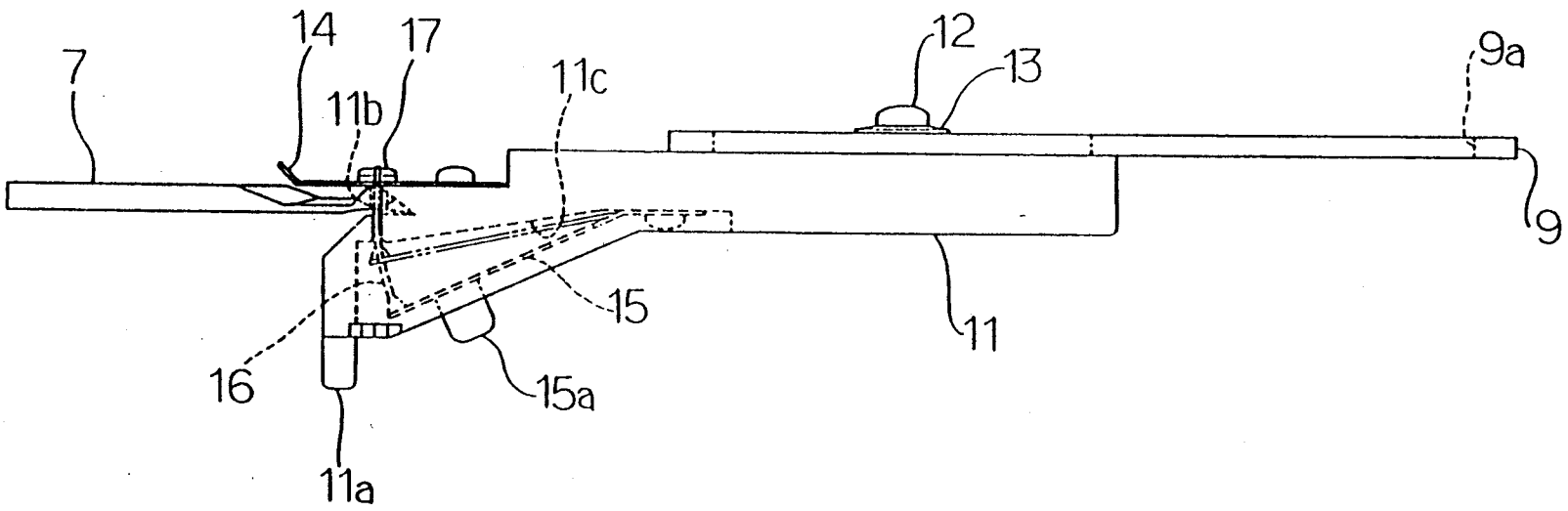
FIG. 5 is a top plan view illustrating a condition that the slide member is in contact with the lower looper.

Referring to FIGS. 3, 4 and 5, a screw 12 is inserted through the elongated hole 9*a* of the mounting plate 9, and is fixed to the slide member 11. A pressure leaf spring 13 is interposed between the screw 12 and the mounting plate 9. Thus, the screw 12 and the pressure leaf spring 13 constitute the guide member according to the present invention for guiding the movement of the slide member 11 along the elongated hole 9*a* of the mounting plate 9.

A lug portion 11*a* is provided at a front, left end of the slide member 11. A lower looper guide plate 14 is mounted on a rear, left end portion of the slide member 11. A positioning portion 11*b* is formed at the rear, left end portion of the slide member 11 on the front side of the lower looper guide plate 14. The positioning portion 11*b* is formed as a recess having such a shape as shown by a dashed line in FIG. 4. That is, the shape of the recess constituting the positioning portion 11*b* is such that a right end portion 7*a* of the lower looper 7 can be closely engaged with the positioning portion 11*b* as shown in FIG. 5.

A groove 11*c* is formed at a front, left portion of the slide member 11 so as to extend in the horizontal direction. A rotating member 15 is located in the groove 11*c*. The rotating member 15 is formed of a leaf spring. The rotating member 15 is fixed at its right end to the slide member 11. Accordingly, the rotating member 15 is rotatable in forwardly and rearwardly directions (as indicated by arrow A in FIG. 4) about the right end thereof. A thread pushing projection 16 for threading the lower looper 7 is provided so as to project rearwardly from a rear surface of the rotating member 15 at the left end thereof. A through hole 11*d* is formed through the slide member 11 at a left end portion of the groove 11*c*, so as to operatively receive the thread pushing projection 16. Thus, when the rotating member 15 is rotated rearwardly, the thread pushing projection 16 is inserted into the through hole 11*d* and projects rearwardly from the through hole 11*d*. Although not shown, the thread pushing projection 16 is formed at its forward end with an arcuate recess, so as to prevent escape of the thread when being pushed by the thread pushing projection 16.

An operating portion 15*a* projects frontwardly from a front surface of the rotating member 15 at a left end portion thereof and a thread guide groove 11*e* is formed at one end of the through hole 11*d* so as to extend vertically.

Figure 6:
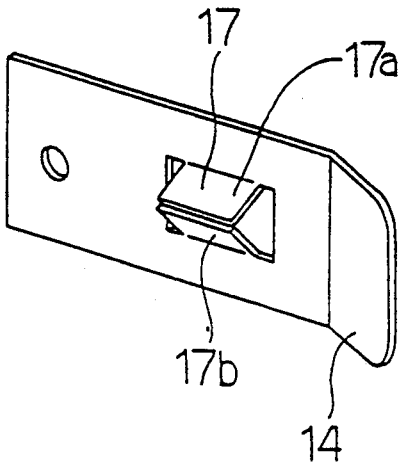
FIG. 6 is a perspective view of a grasping portion.

Referring to FIG. 6, the lower looper guide plate 14 is provided with a grasping portion 17 for grasping the looper thread 22 pushed by the thread pushing projection 16. In this preferred embodiment, the grasping portion 17 is formed of a pair of tongues 17*a* and 17*b* projecting rearwardly, and contacting each other at rear ends thereof, so as to grasp the thread by nipping the same between the rear ends of the tongues 17*a* and 17*b*.

Figure 7:
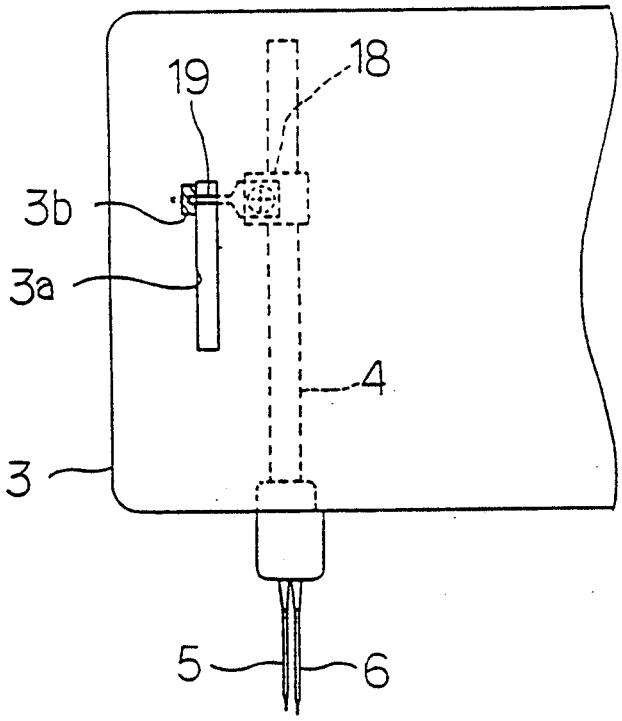
FIG. 7 is a front elevation of an arm of a sewing machine body.

Referring to FIG. 7, a needle bar connecting bracket 18 is fixed to the needle bar 4 and a pointer 19 is mounted on the needle bar connecting bracket 18. A window 3*a* is formed on a front surface of the arm 3, extending parallel to the needle bar 4, so that an operator can observe the pointer 19 through the window 3*a*. By confirming a position of the pointer 19, the operator can confirm the position of the needle bar 4 and, from that, the position of the lower looper 7 moving in synchronism with the needle bar 4. A scale 3*b* for indicating a range of positions for the lower looper 7 where the lower looper 7 can be threaded is provided at an upper end of the window 3*a*.

As shown in FIG. 2, a thread guiding member 20 for guiding the thread inserted through the lower looper 7 and along the lower looper 7 is mounted to the driving mechanism 8 for the lower looper 7. The thread guiding member 20 is provided with an operating member 21 for use in threading so as to be slidable in the right and left directions.

The operation of the sewing machine having the above structure will now be described.

As shown in FIGS. 1 and 2, in inserting the looper thread 22 through an eyelet 7*b* of the lower looper 7, a pulley 31 is rotated by the operator to move the lower looper 7 to a rightmost swing position (i.e., a position substantially corresponding to an upper dead center of the needles 4 and 5). At this time, the pointer 19 (shown in FIG. 7) on the scale 3*b* shows the operator the looper is properly positioned for threading. Then, the lug portion 11*a* of the slide member 11 is operated by the operator to move the slide member leftwardly from the position shown in FIG. 4 until the positioning portion 11*b* comes into engagement with the right end portion 7*a* of the lower looper 7 as shown in FIG. 5. At that time, as shown in FIG. 2, the looper thread 22 is introduced from a lower side of the operating member 21, along a guide path at a left end thereof, into the thread guide groove 11*e* of the slide member 11, and is led upwardly out of the thread guide groove 11*e*.

In this condition, the operating portion 15*a* of the rotating member 15 is pushed by the operator to rotate the rotating member 15 toward the eyelet 7*b* of the lower looper 7 as shown by a two-dot chain line in FIG. 5. As a result, the thread pushing projection 16 formed on the rotating member 15 penetrates into the through hole 11*d* of the slide member 15 and then passes through the eyelet 7*b* of the lower looper 7 until the tip portion of the thread pushing projection 16 is nipped between the tongues 17*a* and 17*b* constituting the grasping portion 17.

At this time, since the looper thread 22 is seated in the thread guide groove 11*e*, the looper thread 22 is pushed by the thread pushing projection 16 to pass through the eyelet 7*b* of the lower looper 7 until nipped between the tongues 17*a* and 17*b* together with the thread pushing projection 16. Thereafter, when the depression force, applied to the operating portion 15*a* of the rotating member 15, is removed, the rotating member 15 rotates away from the eyelet 7*b* of the lower looper 7 by its own spring force and is restored to its original position. As a result, the thread pushing projection 16 is released from the grasping portion 17 and is retracted from the eyelet 7*b* of the lower looper 7. At this time, the looper thread 22 remains nipped by the grasping portion 17. Then, the lug portion 11*a* of the slide member 15 is operated by the operator to move the slide member 11 rightwardly to an original position. As a result, the looper thread 22, nipped by the grasping portion 17, is drawn rightwardly through the eyelet *7b* of the lower looper 7. In this way, the threading operation is completed. Thereafter, as shown in FIG. 3, the operating member 21 is moved leftwardly by the operator until the looper thread 22 is hooked by the thread guiding member 20 (FIG. 3) and then returned to its rightward position (FIG. 2).

According to the above preferred embodiment, the threading through the eyelet *7b* of the lower looper 7 can be effected by firstly moving the slide member 11 to contact the same with the lower looper 7 and then pushing the rotating member 15 to advance the thread pushing projection 16 into the eyelet *7b* of the lower looper 7. Thus, the operator can easily carry out the threading operation as compared with that in the prior art sewing machine using a pincette. The sewing machine of the preferred embodiment is simple in structure since the slide member 11 is displaceable and the thread pushing projection 16 and the grasping portion 17 are provided on the slide member 11. Accordingly, the sewing machine can be easily manufactured at a low cost.

Further, in engaging the positioning portion 11*b* of the slide member 11 with the tip portion *7a* of the lower looper 7, the threading is carried out at the rightmost swing position of the lower looper 7 near which position the tip portion *7a* of the lower looper 7 moves almost horizontally. Accordingly, a range of engagement between the positioning portion 11*b* of the slide member 11 and the tip portion *7b* of the lower looper 7 can be widened. In other words, the range of threading for the lower looper 7 can be widened, thereby simplifying a setting operation of the threading position of the lower looper 7. Additionally, the threading position of the lower looper 7 corresponds to a position where the rotation of the lower looper 7 is stopped and, in fact, reversed upon continued rotation of the pulley 31. Therefore, a setting range of the rotational angle of the pulley 31 can be widened to thereby further simplify the setting operation of the threading position of the lower looper 7.

Although the movement of the slide member 11 to the original position is manually effected by the operator in the above preferred embodiment, a spring may be provided to rightwardly bias the slide member.

What is claimed is:

1. A sewing machine having a threading device, comprising:

a reciprocable needle bar, said needle bar having a needle mounted thereon;

a looper swung in synchronism with said needle bar, said looper having an eyelet;

a supporting member displaceable relative to said looper, said supporting member having a positioning portion for contacting said looper;

a thread pushing projection displaceably mounted on said supporting member for pushing a thread toward said eyelet of said looper, said thread pushing projection capable of penetrating into and retracting from said eyelet of said looper under the condition where said positioning portion of said supporting member is in contact with said looper; and a grasping portion of said supporting member for grasping said thread pushed so as to be inserted through said eyelet of said looper by said thread pushing projection.

2. The sewing machine as defined in claim 1, further comprising: a machine body; and a mounting member fixed to said machine body, said mounting member having an elongated hole extending perpendicularly to a direction of reciprocation of said needle bar, said supporting member being movable along said elongated hole of said mounting member.

3. The sewing machine as defined in claim 2, wherein said supporting member has a lug portion for slidably moving said supporting member along said elongated hole.

4. The sewing machine as defined in claim 1, further comprising a rotating member having one end fixed to said supporting member and having said thread pushing projection mounted at the other end, said rotating member being rotatable about said one end to displace said thread pushing projection, whereby said thread pushing projection can penetrate into and retract from said eyelet of said looper.

5. The sewing machine as defined in claim 4, wherein said supporting member has a through hole allowing passage of said thread pushing member, whereby when said rotating member is rotated, said thread pushing projection is displaced to pass through said through hole and penetrate into or retract from said eyelet of said looper.

6. The sewing machine as defined in claim 4, wherein said rotating member is formed from a leaf spring, whereby after said thread pushing projection is displaced to penetrate into said eyelet of said looper said thread pushing projection is retracted from said eyelet by a spring force of said leaf spring.

7. The sewing machine as defined in claim 4, wherein said rotating member has an operating portion mounted on said rotating member on a side opposite said thread pushing projection to be used for rotating said rotating member about said one end.

8. The sewing machine as defined in claim 1, wherein said grasping portion comprises a pair of opposing tongues for nipping said thread therebetween.

9. The sewing machine as defined in claim 1, further comprising: a pointer mounted on said needle bar; and a window formed on said machine body, said window having a scale for indicating a swing range of said looper permitting threading of said eyelet of said looper so that the threading is permitted by setting said pointer to said scale.

10. A sewing machine having a threading device, comprising:

a machine body;

a reciprocable needle bar, said needle bar having a needle mounted thereon;

a looper swung in synchronism with said needle bar, said looper having an eyelet;

a mounting member fixed to said machine body, said mounting member having an elongated hole extending perpendicularly to a direction of reciprocation of said needle bar;

a slide member slidably mounted on said mounting member to be slidable along said elongated hole of said mounting member, said slide member having a contact portion adapted to contact said looper;

a guide member inserted through said elongated hole and fixed to said slide member for guiding movement of said slide member along said elongated hole of said mounting member;

a thread pushing member for pushing a thread toward said eyelet of said looper, said thread pushing member capable of penetrating into and retracting from said eyelet of said looper under the condition where said contact portion of said slide member is in contact with said looper;

a rotating member having one end fixed to said slide member and the other end provided with said thread pushing member, said rotating member being rotatable about said one end to move said thread pushing member; and a grasping member provided on said slide member for grasping said thread pushed and pierced through said eyelet of said looper by said thread pushing member.

11. A threading device for a sewing machine having a machine body, a machine arm suspended to extend parallel to a surface of the machine body, and a reciprocable needle bar mounted in the machine arm, the threading device comprising:

a looper pivotally mounted in the machine body, said looper pivoting in synchronism with reciprocation of the needle bar;

a mounting member removably attached to the machine body;

a supporting member slidably mounted on the mounting member, said supporting member having a positioning portion for contacting and positioning said looper for threading;

a thread pushing member flexibly mounted on said supporting member adjacent said positioning portion; and a grasping portion on a side of said supporting member adjacent said positioning portion but opposite to said thread pushing member.

12. The threading device of claim 11, wherein said looper further comprises a needle portion for contacting said positioning portion of said supporting member, said needle portion having an eyelet in an end that contacts said positioning portion.

13. The threading device as claimed in claim 11, wherein said mounting member has an elongated hole extending perpendicularly to a direction of reciprocation of the needle bar, said supporting member being slidably mounted to said mounting member to slide along the elongated hole.

14. The threading device as claimed in claim 13, wherein said supporting member has a lug portion for slidably moving said supporting member along said elongated hole.

15. The threading device as claimed in claim 11, wherein said thread guiding assembly comprises:

an extension of said supporting member containing said positioning portion and having a hole passing therethrough; and a thread pushing member flexibly mounted at one end to said supporting member and having a thread pushing projection at an opposite end for passing through said hole in said extension.

16. The threading device as claimed in claim 15, wherein said thread pushing member further comprises a thread guide extending parallel to the needle bar on a side of said extension opposite that to which said thread pushing member is mounted; and a projection on a side opposite said thread pushing projection for causing the flexing of said thread pushing member.

17. The threading device as claimed in claim 11, wherein said grasping portion comprises a pair of opposing tongues for nipping a thread therebetween.

18. The threading device as claimed in claim 11, further comprising a pulley linked to said looper whereby said looper may be manually moved to a threading position immediately below the needle bar.

19. The threading device as claimed in claim 12, further comprising: a pointer mounted on said needle bar; and a window formed on said machine body, said window having a scale for indicating a swing range of said looper permitting threading of said eyelet of said looper so that the threading is permitted by setting said pointer to said scale.

20. The threading device as claimed in claim 15, wherein said thread pushing member is formed from a leaf spring, whereby after said thread pushing projection is displaced to penetrate into an eyelet of said looper, said thread pushing projection is retracted from said eyelet by a spring force of said leaf spring.

* * * * *